US005662572A

United States Patent [19]

Zaoralek

[11] Patent Number: 5,662,572

[45] Date of Patent: Sep. 2, 1997

[54] HEATING ROLLER

[75] Inventor: Heinz-Michael Zaoralek, Königsbronn, Germany

[73] Assignee: Schwabische Huttenwerke GmbH, Germany

[21] Appl. No.: 356,244

[22] PCT Filed: Apr. 25, 1994

[86] PCT No.: PCT/EP94/01285

§ 371 Date: Feb. 17, 1995

§ 102(e) Date: Feb. 17, 1995

[87] PCT Pub. No.: WO94/25670

PCT Pub. Date: Nov. 10, 1994

[30] Foreign Application Priority Data

Apr. 23, 1993 [DE] Germany ..... 43 13 379.7

[51] Int. Cl.[6] ..... B23P 15/00

[52] U.S. Cl. ..... 492/20; 492/9; 492/46

[58] Field of Search ..... 492/46, 9, 20

[56] References Cited

U.S. PATENT DOCUMENTS

| | | | |
|---|---|---|---|
| 4,781,795 | 11/1988 | Miller | 492/46 |
| 4,920,623 | 5/1990 | Neuhoffer et al. . | |
| 4,955,268 | 9/1990 | Ickinger et al. | 492/46 |
| 4,964,202 | 10/1990 | Pav et al. | 492/46 |
| 4,965,920 | 10/1990 | Smith | 492/9 |
| 4,970,767 | 11/1990 | Link | 492/46 |
| 5,079,817 | 1/1992 | Anstötz et al. | 492/46 |
| 5,370,177 | 12/1994 | Fey et al. | 492/46 |
| 5,383,833 | 1/1995 | Brugger et al. | 492/46 |
| 5,397,290 | 3/1995 | Hellenthal | 492/46 |

FOREIGN PATENT DOCUMENTS

| | | |
|---|---|---|
| 387 248B | 12/1988 | Austria . |
| 0 285 081 | 10/1988 | European Pat. Off. . |
| 1 318 133 | 1/1963 | France . |
| 4036121 | 1/1992 | Germany . |
| 9306176 | 8/1993 | Germany . |

*Primary Examiner*—Irene Cuda
*Attorney, Agent, or Firm*—Ratner & Prestia

[57] ABSTRACT

A heating roller for web-like materials, in particular paper has a cylindrical roller body with at least one flange journal. At least one feed line and/or discharge line for a heating medium, in particular steam, are provided. Several, at least, approximately axially aligned and, preferably, disposed peripherally, lines and/or bores pass the heating medium through the roller body. At least one collecting chamber is formed within the heating roller.

14 Claims, 2 Drawing Sheets

HEATING ROLLER

FIELD OF THE INVENTION

The present invention pertains to heating roller used for processing web-like materials, e.g. paper.

BACKGROUND OF THE INVENTION

Heating rollers for web-like materials consist of a cylindrical roller body, at least one flange journal, at least one feedlline and/or discharge line for a heating medium, e.g. steam, and peripheral bore, lines or passages for passing the heating medium through the roller body. These rollers have a more or less solid roller body into which a larger number of axial bores have been made mostly near the roller surface, i.e., peripherally, a heating medium flowing through these peripheral bores and/or lines and transferring its thermal energy to the walls of the bores and/or lines and thus to the roller surface.

Another type of roller has a tubular roller body, in which the heating medium is passed through the hollow interior of the roller body, transferring its thermal energy to the interior of the roller body.

A significant difference between these two known types of heating rollers consists in that the heating roller type of the type first described above can certainly be used for liquid heating media such as water and thermal oil, but so far have not been used with an especially advantageous thermal transfer medium, namely steam.

This is due to the fact that steam condenses at least partly within the bores and/or lines, and transfers a great portion or all of its heat to the roller body, the roller surface and thus to the web-like material to be processed. The resultant condensate is pressed outwards due to the centrifugal forces mostly occurring in paper working machines, e.g. release super calenders, etc. into the bores and/or lines so that the condensate cannot flow off. Due to this, the bores are increasingly filled with condensate during operation until, finally, the entire bores are closed by water. Due to this, the flow rate of steam and, in parallel, the heating are practically reduced to almost zero. The known heating roller of the type first described above would have to be decelerated in this case to such an extent that the centrifugal forces are no longer sufficient for retaining the water in the bores and/or lines. In the extreme case, this type of roller would even have to be stopped in order to allow the condensate to flow off at least from the bores which are positioned at the top. It is obvious that situations occur at any rate both during the obstruction process and during the subsequent decelerating and emptying processes, which result in a heating roller of this type being heated non-uniformly so that irregular temperature profiles occur along the heating roller which lead to thermally caused deformation and distortions, etc.

For these reasons, steam has not been used as a heating medium for this type of roller. However, steam is an ideal heating medium, since it always condenses preferably at those locations within the roller and transfers its heating capacity to those locations which are the coldest locations. Thus, it is ensured by this property of the heating medium itself that there is always an approximate or uniform temperature profile across the surface which is essential for the treatment of the web-like material, or at the least, across the entire surface of the heating roller.

As opposed to this, the use of steam in the other type heating rollers does not present any problems, since the remaining condensate can be removed from the roller in known fashion either via a commercially available upright siphon or one rotating with the roller.

However, the roller of the type first described above has a decisive cost advantage as compared with the roller of the second type, namely, inasmuch as the heating rollers of the other type have a very large hollow space located in the roller body, and, for this reason, are subject to especially complicated acceptance conditions in many countries, e.g. in the USA, because they are considered to be pressure vessels. It must be borne in mind that the steam pressure is about 20 bar at a temperature of about 211° C. and is about 40 bar at a temperature of about 249° C. However, these complicated acceptance conditions do not apply to vessels having an internal diameter of less than 6 inches, i.e. less than about 152.4 mm., each of the individual axial bores and/or lines of the roller type first described above being considered as an individual vessel in the definition of the vessel.

Thus, consequently the advantage is that, with constant quality, functionality and operational safety, a roller of the type first described above can be produced and offered for sale at much lesser cost than a roller of the other type.

Moreover, the following must be taken into consideration: In order to comply with the line pressures which must be relatively high, e.g. in release supper calenders, namely up to about 450 or even 500 kN/M and, in individual cases, even higher, steel must be used as the material for the heating rollers, because for reasons of heat transfer to the paper, the roller wall must be as thin as possible. Moreover, the roller wall made of steel can be surface-hardened. However, the production cost for producing heating rollers of the other type is increased because of the special acceptance conditions.

SUMMARY OF THE INVENTION

The invention relates to a heating roller for web-like materials, in particular paper, which comprises a cylindrical roller body and at least one, preferably two, flange journals, which are respectively connected to opposite ends of the cylindrical roller body. At least one feed line and/or discharge line for a heating medium extends through at least one of the flange journals. The heating medium, in particular steam, is passed through at least one at least approximately axis-parallel, preferably peripheral bore or line through the heating roller. The bores and/or lines are preferably connected to at least one connecting chamber and/or at least one connecting line with the feed lines and/or discharge lines.

It is the object of the present invention to further develop a roller of the type first described above in such fashion that it can at least substantially eliminate the disadvantage of the heating roller of the prior art. In particular the roller first described above is further developed in such fashion that it can be operated at least partly with a gaseous heating medium, in particular steam.

The advantages attainable with the present invention are based on the fact that at least one collecting chamber for receiving the condensate of the heating medium, preferably steam, is disposed in the heating roller.

Due to this it is possible to also use the roller type first described above for steam, since operating centrifugal forces press the condensate into the correspondingly disposed collecting chamber, from where the condensate, preferably water, can be discharged.

Thus, heating rollers for super calenders or release super calenders which are preferably operated with steam, can be designed for use with the roller of the type first described above which because of the complicated and costly acceptance conditions and the requirements regarding the rollers, can no longer be used.

Moreover, steam is present in any customary paper mill so that in the case of a direct steam heating an additional heating station with heat exchanger for converting steam energy to hot water and a separate circulation pump can be dispensed with.

Moreover, the essential advantage of the roller of the type first described above, is that the bores and/or lines are located very close to the roller surface so that the heat transfer is very advantageous. Since the bores have an inner diameter of less than 6 inches or 152.4 mm the steam-carrying bores and/or lines are not longer considered as pressure vessels, thus the expensive steel mostly used in connection with the stringent acceptance conditions can be eliminated and more economy-priced chill castings can be used.

The roller according to the invention provides a much higher surface temperature than a positive-displacement roller, i.e. a roller of the type, with a given steam temperature.

Steam is almost always available in manufacturing facilities up to pressures of about 10 bar, i.e. approx. 180 ° C., and thus is not a problem Moreover, the amount of condensate present in the roller of the invention is extremely low so that, compared with a heated positive-displacement roller, the risk potential of the roller according to the invention is small.

Since there is no temperature drop of the heating medium, in particular of the steam, occurring as it passes through the roller body there is a completely balanced temperature profile at least across the area accessible to the web-like material, and, preferably across the entire roller area.

The controllability of the heating capacity of the heating roller according to the invention is extremely variable and can be adjusted from zero up to a maximum heating output.

The sealing heads for the flange connections, which are necessary for the heating roller according to the invention, can be much smaller, since, for example, the resulting condensate is only about 3 1 per minute with a heating output of 100 kW. Moreover, it is not necessary to additionally load the sealing heads with the dynamic pressure of a pump disposed within the circuit for a heating medium. Ultimately, no additional energy requirements are needed for the heating and/or the movement of the heating medium. Very high temperatures connected with correspondingly high pressures can be employed with the heating roller according to the present invention. Since sealing heads are available which can be loaded up to 17 bar, temperatures of about 207° C. can be put into practice without any problems.

The collecting chamber can advantageously comprise a peripheral annular chamber at at least one of the axial end portions of the roller body and/or in the area of at least one of the flange journals. This annular chamber is disposed in such fashion with respect to the bores and/or lines that the centrifugal forces cause the condensate accumulating within the bores to be forced into the peripheral annular chamber (s), from where the condensate, in particular water, can be easily discharged.

An annular chamber can be advantageously allocated to each bore in order to receive the condensate via the effect of the centrifugal force.

Each of the collecting chambers regardless of design can advantageously be connected via a discharge, e.g. in the form of at least one bore or at least one tube, to a discharge opening for the condensate. This discharge opening for the condensate may be identical to the feed line and/or discharge line for the heating medium, in particular steam but should at any rate be provided in the end portions of the heating roller and in particular through one or both of the flange journals of the heating rollers.

In order to achieve an additionally increased uniformity of the temperature profile across the roller body, a bore parallel to the axis of the roller, as a rule a centric bore, may be provided through the roller body, through which the heating medium, in particular steam, is passed to the other end of the heating roller and/or roller body so that uniform amounts of steam with a uniform temperature can act from both sides of the roller body.

The temperature of the heating roller according to the invention is advantageously controlled via the amount of the condensate discharged. Such a control can be carried out via a valve means which, according to the invention, can be disposed outside the heating roller.

DETAILED DESCRIPTION OF THE INVENTION

Figure 2:
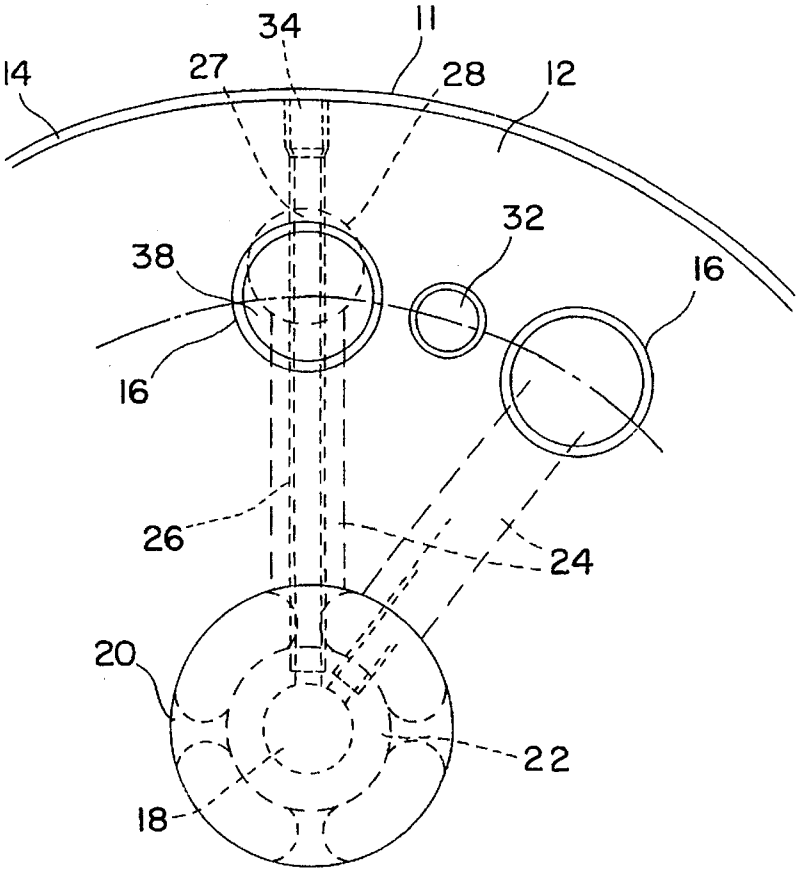
FIG. 2 is a partial cross-section of an end portion of a heating roller according to the invention.

The invention relates to a heating roller for web-like materials, in particular paper, which comprises a cylindrical roller body and at least one, preferably two, flange journals, which are respectively connected to opposite ends of the cylindrical roller body. At least one feed line and/or discharge line for a heating medium extends through at least one of the flange journals. The heating medium, in particular steam, is passed through at least one at least approximately axis-parallel, preferably peripheral bore or line through the heating roller. The bores and/or lines are preferably connected to at least one connecting chamber and/or at least one connecting line with the feed lines and/or discharge lines.

It has not been possible with rollers, other than the type first described above, heated with steam to control the temperature of the roller by throttling the amount of steam without obtaining an extremely irregular temperature profile. Throttling leads to a pressure drop in the roller, because the reduced amount of steam introduced into the roller condenses immediately at the first cold point so that the remote areas are no longer provided with sufficient thermal energy. Consequently, these remoter areas remain cooled, and a completely non-uniform temperature profile is obtained. At the same time, large deviations in the temperature of the circumference of the roller are connected, which can be within the range or beyond the range of the thickness of the web-like material to be treated.

It is not possible with the rollers of the invention to simply throttle the steam supply. According to the invention, control of the condensate discharge via a valve outside the roller makes it possible to control the roller temperature uniformly across the entire temperature range up to the maximum temperature of the heating roller.

The bores and/or lines (passages) disposed near the surface of the roller are filled with condensate and/or water, which is not, or only partly, discharged. In this fashion, the amount of water held in the bores increases, and the free surface of the bores which is capable of receiving the heat from the condensing steam decreases. In this fashion, the roller can receive a smaller amount of heat with an increasing amount of condensate in the bores and/or lines so that the thermal output of the roller according to the invention can be controlled by means of the amount of condensate being discharged. In order to establish a path for the condensate, the bores and/or the lines may be inclined slightly from the center towards the outside. The bores and/or lines can either deviate by about 1 to 100 mm from parallel to the or extend in parallel fashion towards the center.

Advantageously, at least one of the collecting chambers can comprise at at least one end of the bores and/or lines and/or a respective bore or line and a pocket can be designed with a circular cross-section with a diameter preferably smaller than the diameter of the peripheral bore, and the pocket may be offset towards the outside with respect to the peripheral bore and/or line. Due to this, the condensate located in the bores and/or lines near the roller surface is prevented from flowing in a gush from the bores and/or lines in the upper portion of the roller through the steam-supplying connecting lines and/or connecting bores into the bores and/or lines of the lower portion of the roller, if the centrifugal forces acting on the condensate are no longer present. If, the roller according to the invention is stopped to change a paper roll, when the roller is standing still, an excessive mount of the condensate cannot accumulate in the lower portion of the roller in order to create an irregular temperature profile in the diameter of the roller and/or the circumference of the roller so that distortion and warping of the roller body can be prevented. The steam lines must of course be arranged in such fashion that they open into the collecting chamber in such a way that there is an obstacle for the condensate which would otherwise flow off.

On the other hand, when peripheral bores and/or lines (passages) are substantially parallel to the axis of the roller during operation of the roller the condensate flows to the collecting and/or annular chambers or pockets in such fashion that there are no obstacles for the condensate flowing from the bores into the annular chamber and/or the pocket. Connection to the discharge should be provided, e.g. in the form of at least one bore or at least one tube, in such fashion so that no condensates can be formed. There is should be no substantial flow restriction for the condensate flow within the discharge lines.

On the other hand, according to the invention, it should be possible to discharge the entire amount of condensate from the roller during slow-speed operation of the roller or during periods when the roller stands still.

In as much as larger amounts of condensate are obtained during the operation of the roller according to the invention, it may be advantageous to provide a retention means, preferably a non-return valve, flap traps or the like within the bores and/or lines and/or within the connecting chambers or the connecting lines at the end portions of a respective bore and/or line, which retain the condensate at least substantially if the roller runs slowly or stands still, in order to prevent condensate accumulations in the lower portion of the roller which could lead to a non-uniform temperature profile and thus to distortion or warping of the roller.

In order to thermally uncouple amounts of condensate accumulating in the collection chamber and/or the collecting chambers from the rollers and/or bores or lines and thus from the roller body, the end portions of the bores adjoining the respective collecting chambers should be surrounded by heat-insulating material.

The roller designed according to the invention cannot only be used for the release super calenders mentioned above, but also in so-called gloss or soft calenders, in which one or several plastic-coated rollers press the paper web against a heated roller, the surface temperature of the roller not having to be higher than about 160° to 170° C.

The outstanding advantage of the roller according to the invention is, as mentioned above, that in each of the bores and at each point of the bores and/or the roller body there is an almost identical steam pressure and thus also almost the same temperature. Even the smallest temperature deviations along a bore and/or along the roller body result in increased steam condensation at that point, thus the steam gives off a large portion of its energy during condensation, and the temperature is thus again balanced at this point. Much less steam condenses at adjacent points so that a portion being too cold is automatically heated.

According to the invention, it may be advantageous for the heating of the heating roller to use steam to control the temperature of the entering steam by the fact that a moistening follows a throttling of the steam pressure. In this fashion, the steam which can be passed into the heating roller can be enriched or even saturated with moisture so that in the latter case the heating steam is present as wet steam.

Temperature differences occur in all other rollers during the passage of the heating media through the heating rollers due to the emission of heat from the heating medium and the resultant cooling of the heating medium as it passes through the roller body. This makes treatment of the web material non-uniform due to the differing temperatures and, leads to dimensional changes of the roller which also has a disadvantageous effect on the web material.

Figure 1:
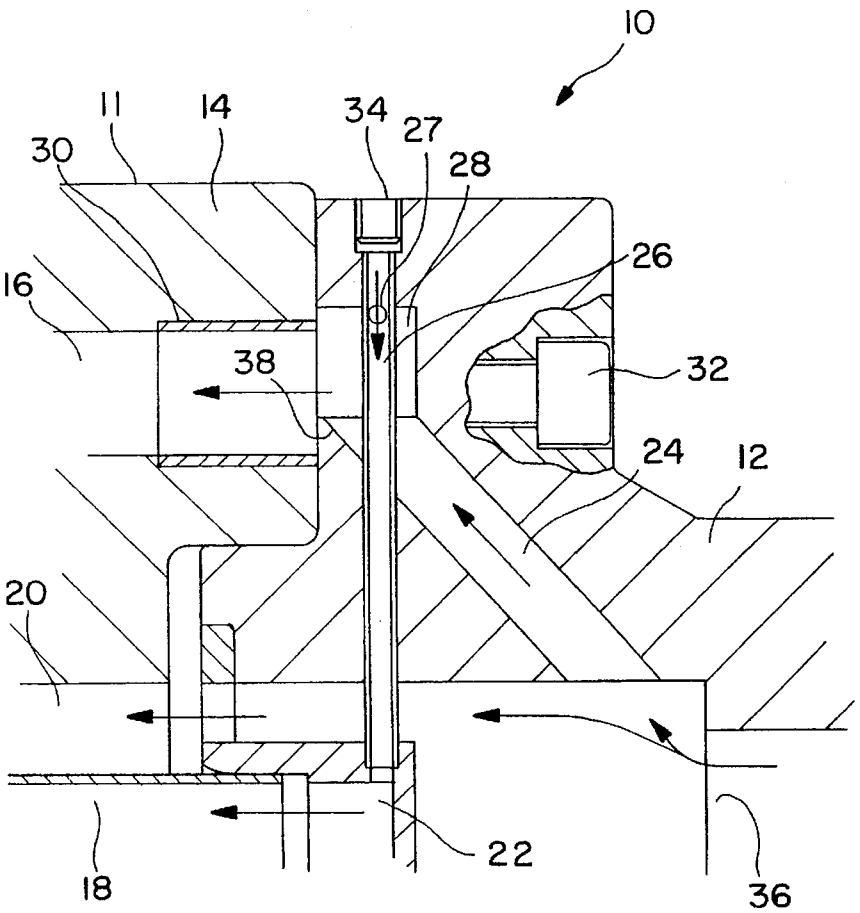
FIG. 1 is a partial longitudinal section through an end portion of a heating roller according to the invention.

The heating roller designed according to the invention is in general designated with the reference numeral 10 in FIG. 1. The roller 10 comprises a flange journal 12, preferably on each side, and a cylindrical roller body and/or roller shell 14 whose surface 11 is used for the pressure-processing of a web-like material, in particular paper, synthetic material or the like. A heating medium is introduced into the heating roller 10 via a feed line extending through the flange 12.

In the embodiment represented in FIG. 1 the steam is introduced into connecting lines 24, via the feed line 36. Part of the steam from feed line 36 is passed via line 20 disposed parallel to the axis of and in the central portion of the roller 10 to the other end of the heating roller 10. The steam enters the collecting chamber 28 via the connecting line 24. Steam condensate can accumulate in chamber 28 during operation of the heating roller 10 when sufficient centrifugal forces occur.

The collecting chamber 28 is disposed adjacent to the bores and/or lines (passages)16. Bores and/or lines 16 may be substantially or nearly parallel to the axis of roller 10. One collecting chamber 28 may in each case be allocated respectively to one bore and/or line 16. On the other hand, or additionally, a peripheral annular-shaped collecting chamber could be allocated to all bores 16.

In the present case, the collecting chamber 28 is provided in the flange 12 connected to the roller body 14 by means of fastening means 32.

The axis of collecting chamber 28 is offset with respect to the central axis of the respective bore 16. Due to this offset, condensate flow through the connecting line 24 into the lower portion of the heating roller 10 can be prevented during the slow-speed operation of standstill of the roller.

whereby non-uniform temperature profiles, changes in the diameter of roller 10 and a detrimental effect on the material to be processed may not occur. Due to the design of the collecting chamber 24 with a smaller diameter and axial displacement an obstacle 38 is formed, which prevents the the condensate from flowing out of bore 16 via the feed line 24.

A part of the steam is passed to a corresponding arrangement on the opposite side of the heating roller 10, which is shown in FIG. 1 and/or FIG. 2 due to the bore 20 being disposed concentrically or parallel to the axis within the heating roller 10. Steam is introduced into the entire length of the bores and/or lines 16 and thus into the roller body 14 in order to achieve in this fashion a still more uniform temperature profile.

Insulation 30 is disposed in the marginal area and/or the end area of the bores 16 in order to bring about a thermal uncoupling of the condensate which may be contained within the collecting chamber 28. Additional insulation may be provided in the boundary area between the flange journal 12 and the roller body 14, e.g. on the side of the flow obstacle 38 pointing towards the roller body 14.

In order to ensure the discharge of the condensate during operation at least one bore and/or a tube 26 is provided which is connected to the collecting chamber 28. The condensate is conveyed from the collecting chamber 28 into a condensate collecting chamber 22 via orifice 27 in tube 26 and from there into a condensate discharge line 18. The conveying of the condensate can be effected via the stream pressure or via a partial vacuum applied to the chamber 22 and thus to the line 18. In order to arrange the tube 26 in the flange 12 a radial duct may be drilled in the flange 12. The tube 26 may be pushed into this radial duct and tube 26 can be closed towards the outside of flange 12 by means of a seal fixed within the duct.

The tube 26 has an opening or orifice 27 which is positioned, if possible, near the outer end of the collecting chamber 28 so that it does not form any obstacle for the condensate.

Retention means such as a non-return valve or the like may be provided in the end portion of the bore 16 and/or in the area of the collecting chamber 28 in order to prevent the condensate from flowing out of chamber 28 and an accumulation of this condensate in the lower portion of the roller 10 in the case of a standstill or a slow-speed running of the roller. In this case the flow obstacle 38 according to FIG. 1 is not imperative so that the connecting line can open directly into the bore 16 without having a direct connection with the collecting chamber 28.

Annular chambers may also be provided at the roller ends to supply steam to each peripheral bore 16 and for the discharge of the condensate from line 18. Annular chambers will replace feed line 24 and tubes which are connected to all peripheral bores 16 for the distribution of the steam and discharge of the condensate.

A valve means may be provided outside the roller 10, which adjoins the line 18, via which the condensate discharge and thus the temperature of the roller can be controlled. The condensate can be withdrawn via the aforementioned flow path, driven by the centrifugal force and/or the steam pressure and/or a suction applied from the outside.

The condensate collecting chambers 22 may also be located in the flange journals via which the condensate can get into the discharge line 18.

If the line 18 is not used it is advantageous if the steam can be passed via the feed lines and/or discharge lines 26 provided in flange journals 12.

A partial cross-section through a heating roller designed according to the invention is shown in FIG. 2, which again shows the position of the collecting chamber 28 for the condensate which is offset with respect to the borer and/or the line 16.

As for the rest, the elements represented in FIG. 2 have the same reference numerals as the elements represented in FIG. 1.

The required elements such as the collecting chamber 28 and the elements connected with the tube 26 are not represented in the connecting line 24 which is obliquely disposed with respect to the vertically oriented connecting line 24 in order to emphasize the required elements connected with the vertically aligned connecting line 24.

Figure 3:
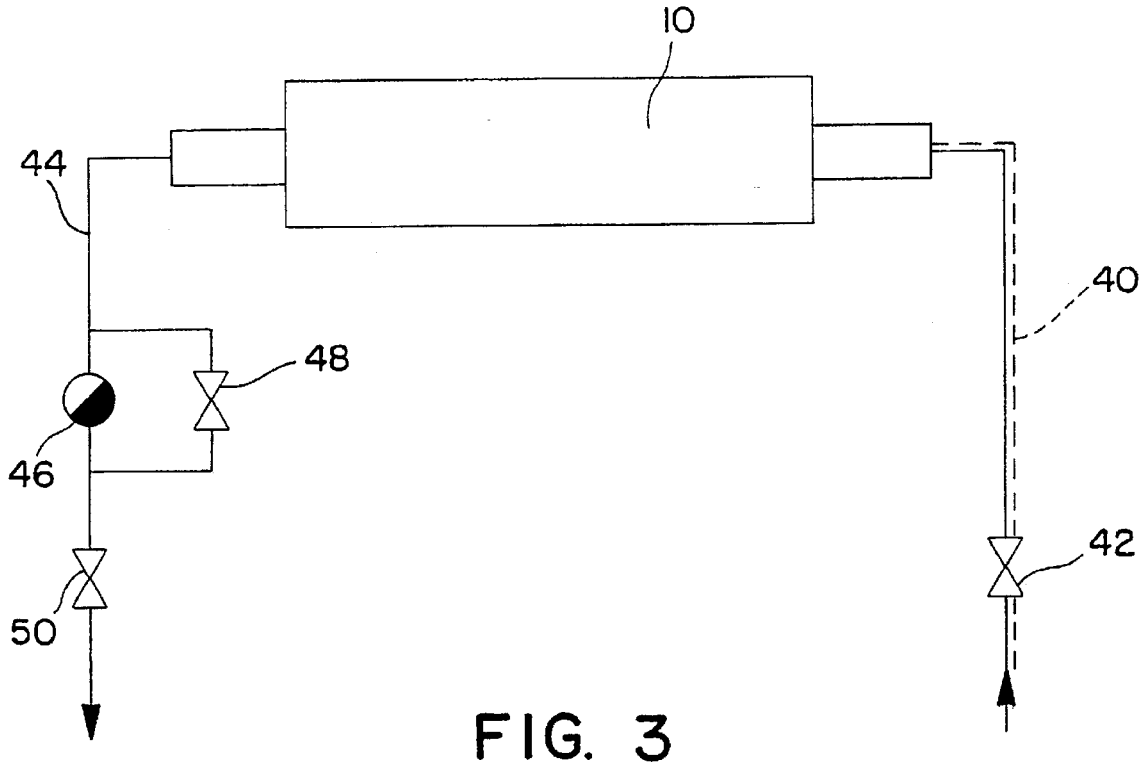
FIG. 3 is a schematic flow diagram showing steam supply and condensate discharge for a heating roller in accordance with the present invention.

A possible flow circuit for the roller 10 according to the invention is represented in FIG. 3. The supply of heating medium and/or steam to the heating roller 10 according to the invention can be controlled via the feed line 40 and a shutoff valve 42 disposed in the feed line 40. The steam introduced into the heating roller 10 is preferably partly moistened or completely saturated after a pressure relief so that the steam supplied to the heating roller 10 is saturated steam or wet steam. The foregoing embodiment suggests that the steam is supplied via one flange journal of the roller 10, and the condensate with and/or without the steam portion is withdrawn from the opposite flange of the heating roller 10 according to the invention. Both operations or steps could, of course, be performed via the same flange of the heating roller 10 according to the invention. A discharge line 44 for the condensate possibly with steam admixture is provided on the discharge side. The circuit includes a condenser 46 which works in known fashion. A bypass valve 48 is disposed in parallel to the condenser 46 and may be provided, e.g. for safety purposes. Moreover, the circuit includes a condensate control valve 50 for a heating medium for the heating roller (10) according to the invention, by means of which the amount of condensate withdrawn from the heating roller 10 can be controlled. Due to this, continuous control of the temperature of the heating roller 10 is brought about by adjusting the discharge of the condensate in the bores and/or lines 16 near the roller surface of the heating roller 10 to a high rate. If too much condensate is withdrawn, i.e. if the condensate control valve 50 is completely open, the steam introduced into the heating roller 10 can completely give off its thermal energy to the surface of the bores 16. If, on the other hand, the condensate is only partly discharged, a large portion of the surface of the bores 16 is completely occupied by condensate and is not accessible to the steam so that the steam can only give off its thermal energy to parts of the surface of the bores 16. If the condensate control valve 50 is completely closed, no condensate flows off, the bores get clogged and the steam passage is suppressed. In this case, the heating roller 10 cools rapidly together with the condensate contained therein.

What is claimed is:

1. A heating roller for web-like materials, in particular paper, comprising:

cylindrical roller body, at least one flange journal, at least one feed line and discharge line for a heating medium, in particular steam, several, at least approximately axis-parallel, preferably peripheral passages for passing the heating medium through the roller body, the improvement comprising at least one collecting chamber disposed within the heating roller at the ends of the peripheral passages in order to receive the condensate formed by the condensation of the heating medium, preferably steam.

2. A heating roller according to claim 1 wherein at least one of a connecting chamber and connecting line is provided for the passages.

3. A heating roller according to claim 2, wherein each collecting chamber comprises a circumferential annular chamber in at least one axial end portion of one of the flange journals in the area adjacent said roller body.

4. A heating roller according to claim 3, wherein a collecting chamber is allocated to each passage.

5. A heating roller according to claim 4 wherein a discharge, in the form of at least one of a bore or tube is provided, which corresponds to one of a respective collecting and annular chamber.

6. A heating roller according to claim 5, wherein a line is provided within the roller body in order to pass the heating medium to one of another end of the heating roller and the roller body.

7. A heating roller according to claim 6, wherein discharge of the condensate can be controlled by a valve means.

8. A heating roller according to claim 7, wherein at least one of the passages is one of inclined towards the central axis of the roller about 1 to 100 mm from axial parallelism or extends exactly in axis-parallel fashion.

9. A heating roller according to claim 8, wherein at least one of the collecting chambers comprises at least at one end of the passages a generally round pocket, which has a diameter being smaller than the diameter of the passage, the pocket being outwardly offset with respect to the passage.

10. A heating roller according to claim 9, wherein temperature control can be carried out by means of pressure control of the steam with subsequent moistening of the steam.

11. A heating roller according to claim 9 wherein six, at least approximately axis-parallel, peripheral passages are disposed.

12. A heating roller according to claim 10, wherein a retention means, selected from the group comprising a non-return valve, or flap trap for retaining the condensate is disposed in one of the connecting chamber or connecting lines at the end portions of the respective passage.

13. A heating roller according to claim 12, wherein the end potions of the passages are provided with a heat-insulating material.

14. A heating roller according to claim 13, wherein at least one constriction is provided in the end portions of one of the approximately axis-parallel passages in order to retain condensate in particular if the roller stands still.

* * * * *

UNITED STATES PATENT AND TRADEMARK OFFICE

CERTIFICATE OF CORRECTION

PATENT NO. : 5,662,572
DATED : September 2, 1997
INVENTOR(S) : Heinz-Michael Zaoralek It is certified that error appears in the above-identified patent and that said Letters Patent is hereby corrected as shown below:

On the cover, under Foreign Patent documents delete "9306176" and replace with --9306176U--.

Column 8, line 59, after the word "journal" add --connected to an end of said roller body--.

Column 8, line 60, after the second occurrence of the word "line" add --in said flange journal--.

Column 8, line 61, after the word "steam" add --in said flange journal--.

Column 8, line 63, after the word "passages" add --in said roller body--.

Column 10, line 19, delete the word "potions" and substitute therefor --portions--.

Signed and Sealed this

FourthDay of August, 1998

Bruce Lehman

*Attest:*

BRUCE LEHMAN

*Attesting Officer*

*Commissioner of Patents and Trademarks*